United States Patent [19]

Burr

[11] Patent Number: 4,665,836

[45] Date of Patent: May 19, 1987

[54] TABLE INTERCONNECTING APPARATUS

[75] Inventor: Alan C. Burr, East Norwalk, Conn.

[73] Assignee: Howe Furniture Corporation, Trumbull, Conn.

[21] Appl. No.: 833,352

[22] Filed: Feb. 19, 1986

[51] Int. Cl.[4] ..... A47B 57/00

[52] U.S. Cl. ..... 108/64; 108/59

[58] Field of Search ..... 108/64, 65, 66, 69, 108/73, 75, 78, 59, 89; 312/203, 198, 111; 403/306

[56] References Cited

U.S. PATENT DOCUMENTS

| | | | |
|---|---|---|---|
| 2,053,659 | 9/1936 | Gisser | 108/65 |
| 2,661,988 | 12/1953 | Steene et al. | 108/64 |
| 2,836,475 | 5/1958 | Sapp | 108/64 |
| 2,959,792 | 11/1960 | Haugard | 108/64 X |
| 3,342,147 | 9/1967 | Shettles | 108/64 |
| 3,820,477 | 6/1974 | Griffin | 108/64 X |
| 3,915,100 | 10/1975 | Sullivan | 108/64 |
| 3,964,809 | 6/1976 | Wirbilowicz et al. | 312/111 |
| 4,290,710 | 9/1981 | Naller | 312/111 X |
| 4,301,744 | 11/1981 | Walter | 108/78 X |

FOREIGN PATENT DOCUMENTS

| | | | |
|---|---|---|---|
| 1379657 | 10/1964 | France | 108/64 |
| 1422251 | 11/1965 | France | 108/64 |
| 618804 | 2/1949 | United Kingdom | 108/64 |

*Primary Examiner*—Kenneth J. Dorner
*Assistant Examiner*—José V. Chen
*Attorney, Agent, or Firm*—Parmelee, Bollinger & Bramblett

[57] ABSTRACT

Each of two or more sectional tables is provided with interconnecting apparatus for forming different sized and various shaped table configurations. Each sectional table (10, 12, 14) is provided with a set of spaced threaded inserts (38, 40) positioned on its underside. First and second sectional tables may be abutted with their respective sets of inserts aligned. A slotted coupling link (20) having spaced slots (28, 30) with first and second ends in opposite ends of the link is utilized with thumb screws (42) which are threaded into the inserts. The screws pass through the slots for positioning the coupling link between a first, retracted, position in which it is completely positioned on the underside of one of the sectional tables and a second, extended, position in which it extends beneath both sectional tables and is secured by the thumb screws. By simply removing or loosening the screws and sliding the coupling link out of engagement with one of the sectional tables, the tables can be separated, and the interconnecting apparatus conveniently stored under one of them. A wide variety of sectional table shapes and sizes allows table configurations to be varied in accordance with the desires of the user.

6 Claims, 8 Drawing Figures

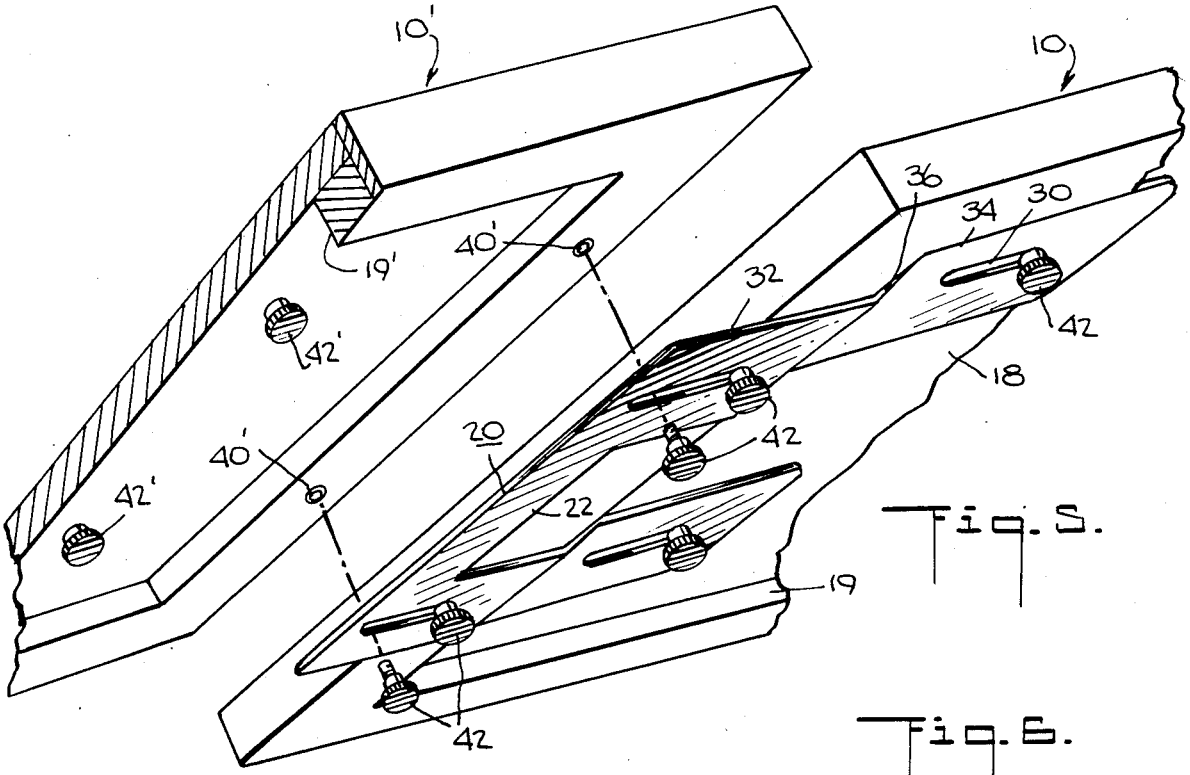
Fig. 5.
Fig. 6.
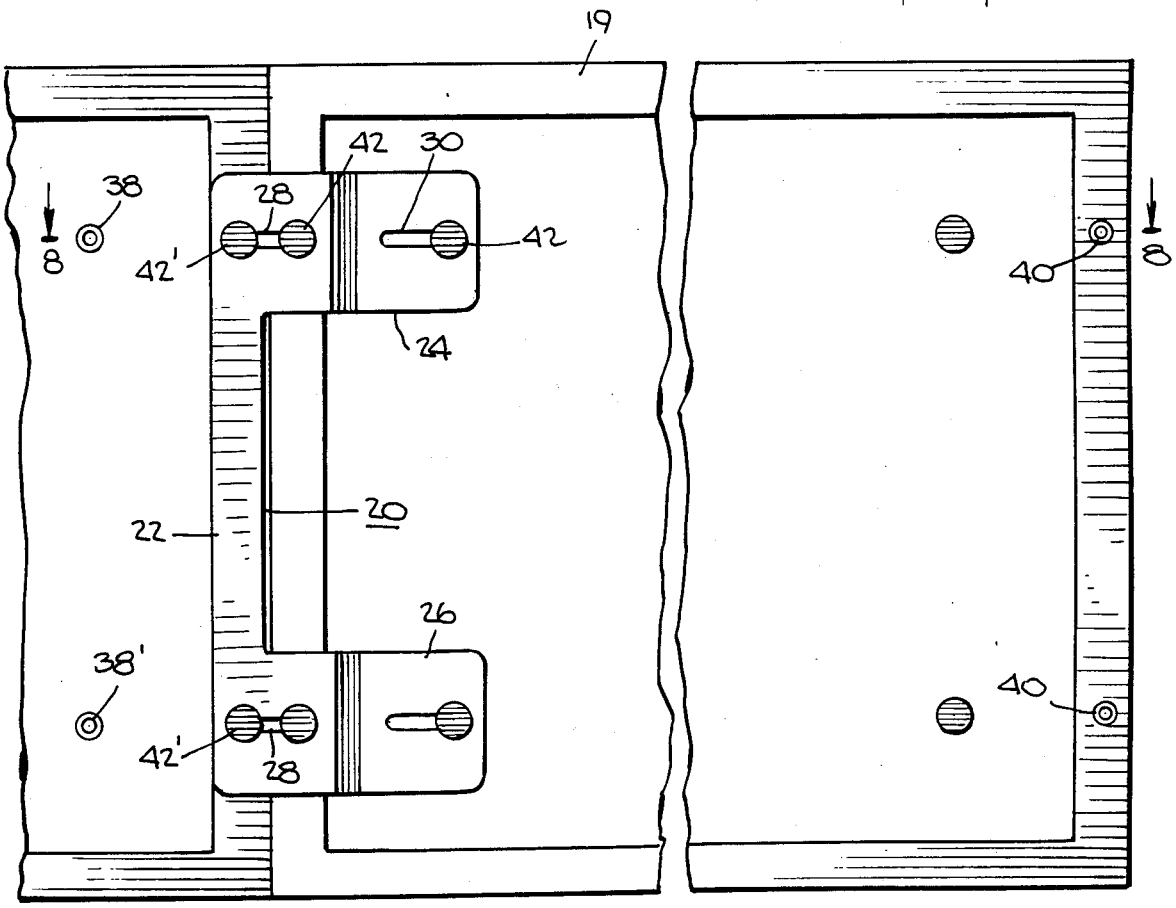

TABLE INTERCONNECTING APPARATUS

TECHNICAL FIELD

This invention relates to table interconnecting apparatus and, more particularly, to such apparatus which is conveniently located on the undersides of two or more sectional tables. The apparatus is employed to form different sized and various shaped table configurations by readily connecting and disconnecting the sectional tables.

BACKGROUND OF THE INVENTION

A variety of table shapes and sizes are employed in commercial as well as domestic applications, and it would be convenient to utilize table sections in various interconnected configurations for such applications as conference rooms, boardrooms, and cafeterias. Tables can be inadvertently moved and, accordingly, it would be desirable to provide some form of stable interconnection. One application for example, would be the use of interconnected sectional tables in a U shape for a seminar. At the conclusion of the seminar, the tables might quickly be disconnected, and rearranged in accordance with the desires of the user. Interconnecting table sectiions would provide greater versatility, better appearance, and more stability than merely grouping discrete tables.

Accordingly, it is an object of this invention to provide a new and improved apparatus for interconnecting two or more sectional tables which is easy to connect and disconnect. Another object of this invention is to provide a new and improved interconnecting apparatus for sectional tables which is completely out of sight. Still a further object of the present invention is to provide a new and improved apparatus for interconnecting two or more tables which is simple in construction, efficient, and inexpensive.

DISCLOSURE OF INVENTION

In carrying out this invention in one illustrative embodiment thereof, an apparatus is provided for interconnecting two or more sectional tables to form different sized and various shaped table configurations. The sectional tables can be readily connected and disconnected for modifying the composite table configuration. First and second sectional tables have respective first and second sets of spaced sockets positioned on their undersides. The first and second sets of sockets are capable of being aligned when the table sections are abutted. A coupling link having spaced slots in its opposite ends is provided with fastening means for removably positioning the coupling link between the table sections. The fastening means are removably positioned in the sockets and extend through the slots whereby the link may be mounted in either of a first and second position. In the first position, the coupling link is completely positioned on the underside of one of the sectional tables with each of the fastening means positioned near a first end of its respective slot. In a second position, the coupling means extends under, and interconnects, two sectional tables.

By removing the fastening means from one of the tables and loosening the fastening means under the other table, the slotted link may be retracted and stored totally under one table section. Alternately, the fastening means may be loosened, the slotted link extended under another table and a fastening means tightened in sockets under the other table to link them together.

BRIEF DESCRIPTION OF THE DRAWINGS

The invention, together with further aspects, objects, features and advantages thereof, will be more clearly understood from the following description taken in connection with the accompanying drawings in which like elements are designated with the same reference numerals throughout the various views.

FIG. 5 is an exploded view of the apparatus of FIG. 4 illustrating the interconnecting link in its extended position and aligned with an adjacent table to which it is to be connected;

FIG. 6 is a bottom view of the apparatus of FIG. 5 illustrating the two sectional tables interconnected by the link of the present invention;

BEST MODE FOR CARRYING OUT THE INVENTION

Figure 1:
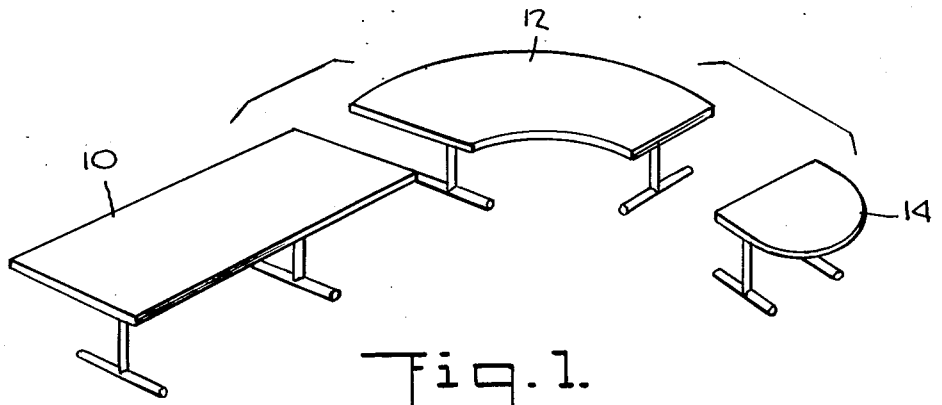
FIG. 1 is a perspective view of several differently shaped disconnected sectional tables.

Referring now to FIG. 1, a plurality of differently shaped sectional tables 10, 12 and 14 are illustrated. These sectional tables are of the same height and may be interconnected utilizing the apparatus of the present invention. The sectional tables 10, 12 and 14 are, in fact, separate tables and may be used as such.

Figure 2:
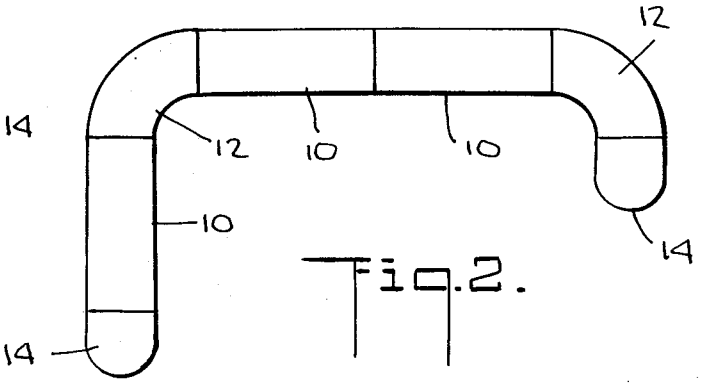
FIG. 2 is a top view of several of the same and different tables interconnected to form a modified C-shaped configuration.

FIG. 2 illustrates an assemblage of a plurality of tables such as shown in FIG. 1 interconnected by the apparatus of the present invention. The interconnected sectional tables form a single larger and differently shaped table which can be readily modified in accordance with the desires of the user. It will be appreciated that the invention is not restricted to any particular table size or shape or to any particular unitary configuration when the table sections are assembled in accordance with the present invention. The only requirement is that the sectional tables have the same height so that they may be joined and provide a relatively flat, continuous upper surface. The invention has applications in many locations, domestic and commercial, including, for example, offices, conference rooms, factories, and restaurants where it is desirable from time-to-time to interconnect tables rather than to purchase or build tables of unusual size or shape. The present invention provides means for constructing tables of a variety of shapes and sizes using sectional tables which are assembled in the arrangement desired.

Figure 3:
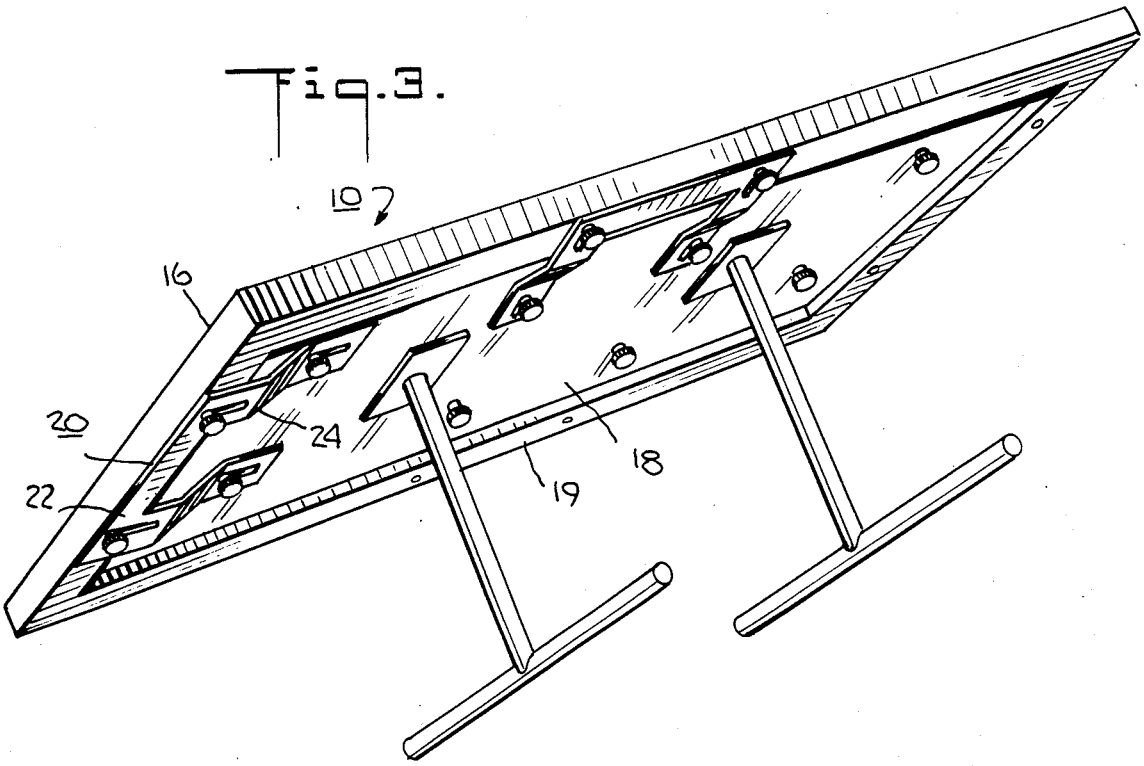
FIG. 3 is a perspective view illustrating the underside of a sectional table with the interconnecting link of the present invention in a retracted position.
Figure 4:
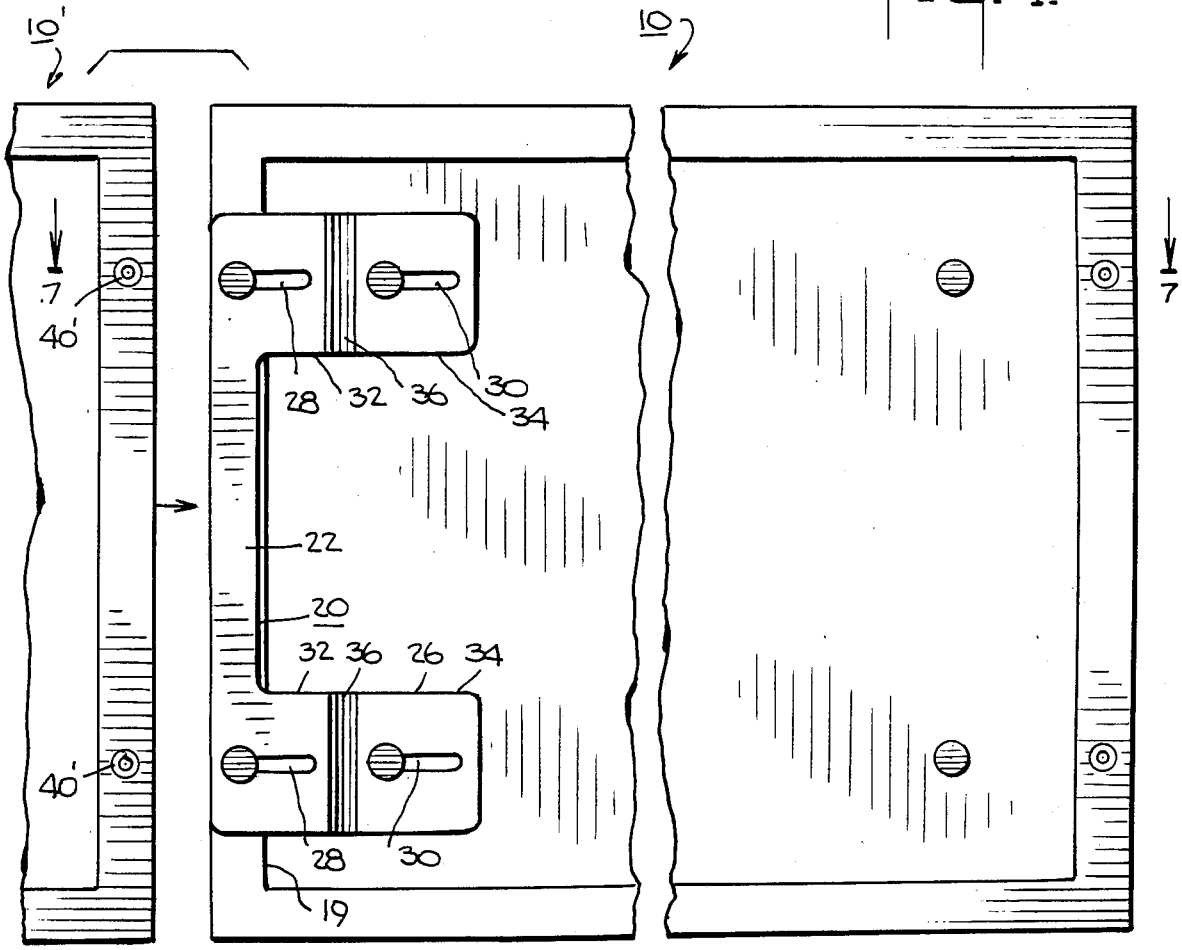
FIG. 4 is a partial bottom view of the table of FIG. 3 showing a retracted interconnecting link and a portion of an adjoining table section.

FIGS. 3 and 4 illustrate the interconnecting apparatus of the present invention positioned on the underside of the table 10. All four sides of the table are provided with similar sets of threaded inserts 38, 40. Preferably, each set of inserts (or tapped holes) is centered relative to a table edge. Each table carries two coupling links 20, preferably one on each of a long and a short side. Non-rectangular tables, such as table 12 in FIG. 1 would have inserts adjacent each straight side but probably only one link. A table 14 with only one straight side would carry one set of inserts and one link adjacent that side. It will be appreciated that the interconnecting apparatus of the present invention is similarly applied to the undersides of all of the tables of a set which may then be connected in accordance with the present invention. Thus, two rectangular tables 10 could be connected side to side, end to end, or in a T-shape. The invention is described with reference to table 10 to simplify the description as well as to explain how the invention works.

The table 10 has a top 16 with an underside 18 and a peripheral flange 19. A slotted coupling link 20 has a base plate 22 with a pair of legs 24 and 26 extending therefrom in a generally U-shaped configuration. Each of the legs 24 and 26 has a pair of spaced forward and rearward slots 28 and 30, respectively, in forward and rearward offset sections 32 and 34. Sections 32 and 34 are in separate but parallel planes interconnected by an angled section 36 in each of legs 24 and 26, respectively. The angled sections 36 permit the coupling link 20 to be mounted with section 34 flush against the bottom or undersurface 18 of the table 10, while section 32 is flush against the underside of the peripheral flange 19.

Figure 8:
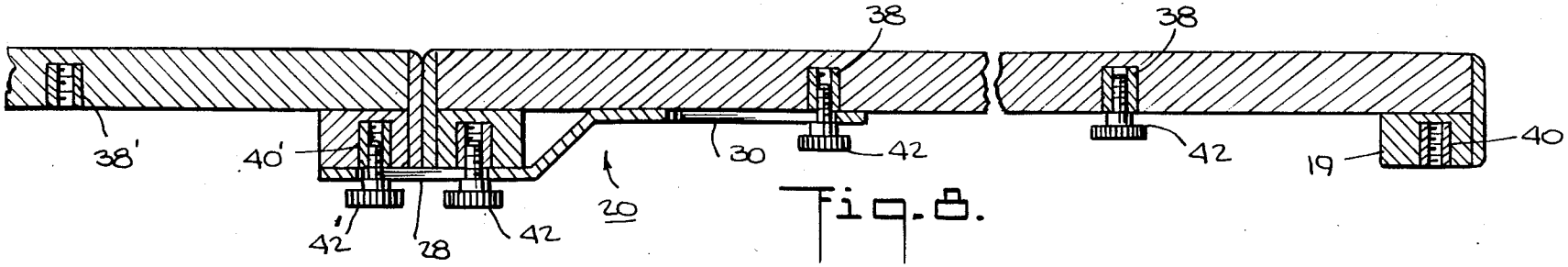
FIG. 8 is a cross-sectional view taken substantially along line 8—8 of FIG. 6 illustrating the coupling link in its extended position interconnecting two sectional tables.

As will best be seen in FIGS. 3 and 8, the underside 18 of table 10 includes a plurality of aligned pairs of similar threaded inserts 38 and 40. The inserts 40 are located in the peripheral flange 19. There are in fact, four such sets of four aligned inserts 38 and 40, one set being located at the center of each table edge. (Tapped holes could be provided in place of inserts.) Two slotted coupling links 20 are mounted along one short and one long table edge by screws 42 threaded into inserts 38 and 40. The slots 28 and 30 of the coupling link 20 are aligned with the inserts and screws 42 extend therethrough. When loosened, screws 42 permit the sliding of the coupling link 20.

Figure 7:
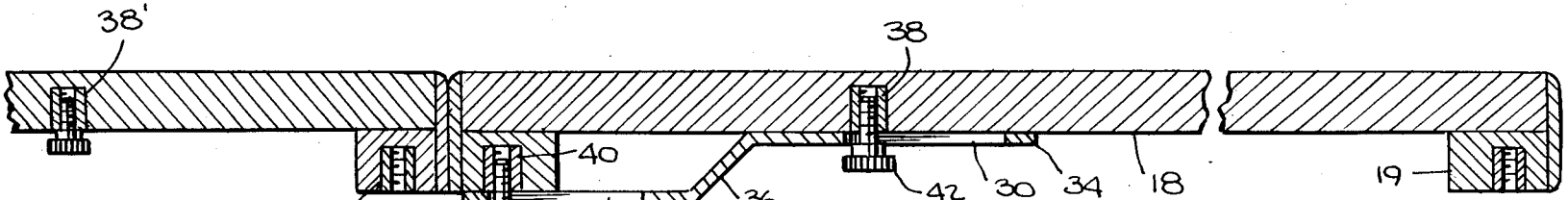
FIG. 7 is a cross-sectional view taken substantially along line 7—7 of FIG. 4 illustrating the coupling link in a retracted position totally under one table section.

As will best be seen in FIGS. 4 and 7, when the tables 10 are not interconnected, the coupling link 20 may be stored by sliding it under the table top 16 to the limit of the slots 28 and 30 as shown in FIGS. 4 and 7, and then tightening the screws 42. This positions coupling link 20 out of sight on the underside 18 of the table 10.

When it is desired to interconnect two or more tables, they are positioned in the desired abutting relationship with the inserts 40 in the respective peripheral flanges 19 in alignment. This initial position is shown in FIG. 7. The screws 42 are then loosened, and the slotted coupling link 20 is slid forward to the maximum extent permitted by the length of the slots 28, 30 which are of equal length. In the extended position of the coupling link 20, the ends of slots 28 just clear the inserts 40' in adjoining table 10'. The screws 42' are then removed from their stored locations in inserts 38' inward from the table edge and are threaded into inserts 40' through the slots 28. Since each of slots 28 has a screw 42, 42' at each end, the table edges are held closely together. Furthermore, this is achieved without requiring tightening of the screws which may be only finger-tight. This procedure effectively clamps the two table sections together as illustrated in FIGS. 6 and 8.

The tables are easily disconnected by removing the outer screws 42' in inserts 40' from the slots 28, loosening the remaining screws 42, securing the link and sliding the coupling link back in its retracted position, and then refastening the screws. Accordingly, in any interconnecting arrangement for interconnecting two tables, only two screws must be totally removed and replaced in their sockets to accomplish the interconnecting arrangement. The remainder of the operation may be done simply by loosening the screws 42, and sliding the coupling link to its expanded or extended position or retracting the coupling link to its retracted or stored position.

Since the coupling apparatus is conveniently stored on the bottom of a table when not in use, it is always available for use without reattachment or substantial manipulation or readjustment. The apparatus of the present invention is simple, sturdy, efficient, and easy to use.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. Apparatus for interconnecting two or more sectional tables to form different composite table configurations which can be readily modified comprising:

a first sectional table having a top bounded by an edge and a first set of spaced sockets positioned on the underside of said top;

a second sectional table having a top bounded by an edge and a second set of spaced sockets positioned on the underside of its top and alignable with the first set of spaced sockets when the first and second sectional tables are positioned with their edges abutting;

a coupling link mounted on the underside of said first table top having at least one slot with first and second ends aligned substantially perpendicular to the edge of said table top;

fastening means removably positioned in said sockets and positionable through said slot for mounting said coupling link either of (a) a first, retracted, position in which said coupling link is completely positioned on the underside of said first table top with a first fastening means positioned at a first end of said slot or (b) a second, extended, position in which said coupling link extends under and interconnects the first and second table tops with said first fastening means positioned at the second end of said slot and second fastening means positioned at the first end of said slot and secured in the second set of sockets.

2. The apparatus as claimed in claim 1 wherein said coupling link is U-shaped having a base with a pair of slotted legs extending therefrom.

3. The apparatus as claimed in claim 2 wherein each of said legs has a forward and rearward slot therein.

4. The apparatus as claimed in claim 2 wherein each of said sectional tables has a depending peripheral flange containing one socket of each set of spaced sockets, and wherein the legs of said coupling link have angled mid-sections to permit the base of said coupling link to be flush with the peripheral flange and said legs to be flush with the underside of said table top.

5. The apparatus as claimed in claim 1 wherein more than two sectional tables are interconnectable, each additional sectional table having (a) a top at the same height as said first and second sectional tables, (b) sets of sockets in the underside of its top alignable with the first or second set of sockets of either of said first and second sectional tables and (c) a coupling link secured to one set of sockets.

6. The apparatus of claim 1 wherein each of said sockets is a threaded hole and each of said fastening means is a thumbscrew.

* * * * *